US006997366B2

(12) United States Patent
Manabe

(10) Patent No.: US 6,997,366 B2
(45) Date of Patent: Feb. 14, 2006

(54) CARTRIDGE

(75) Inventor: Katsunori Manabe, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 12 days.

(21) Appl. No.: 10/500,810

(22) PCT Filed: Jan. 14, 2003

(86) PCT No.: PCT/JP03/00200

§ 371 (c)(1),
(2), (4) Date: Jul. 7, 2004

(87) PCT Pub. No.: WO03/061911

PCT Pub. Date: Jul. 31, 2003

(65) Prior Publication Data

US 2005/0077337 A1 Apr. 14, 2005

(30) Foreign Application Priority Data

Jan. 18, 2002 (JP) ..... 2002-009763

(51) Int. Cl.
*B25C 5/02* (2006.01)

(52) U.S. Cl. ..... 227/120; 227/131

(58) Field of Classification Search ..... 227/131, 227/120, 136, 135, 119, 155; 206/340, 398, 206/408

See application file for complete search history.

(56) References Cited

U.S. PATENT DOCUMENTS 3,224,657 A 12/1965 Zike
4,570,841 A 2/1986 Olesen
6,039,230 A * 3/2000 Yagi et al. ..... 227/120
6,050,471 A * 4/2000 Yagi ..... 227/119
6,371,352 B1 * 4/2002 Mochizuki ..... 227/155
6,557,744 B1 * 5/2003 Kitamura ..... 227/119
6,715,654 B1 * 4/2004 Sugihara et al. ..... 227/2
6,892,919 B1 * 5/2005 Higuchi et al. ..... 227/2
6,899,259 B1 * 5/2005 Takeuchi et al. ..... 227/120
6,902,094 B1 * 6/2005 Mochizuki et al. ..... 227/155
6,918,527 B1 * 7/2005 Hakozaki et al. ..... 227/131

FOREIGN PATENT DOCUMENTS

| | | |
|---|---|---|
| EP | 0 838 315 A2 | 4/1998 |
| EP | 0 861 708 A1 | 9/1998 |
| EP | 0 917 936 A2 | 5/1999 |
| JP | 2-23969 | 2/1990 |
| JP | 7-17477 | 3/1995 |
| JP | 11254347 | 9/1999 |
| JP | 2000167782 | 6/2000 |
| JP | 2001-347472 | 12/2001 |

* cited by examiner

*Primary Examiner*—Scott A. Smith
(74) *Attorney, Agent, or Firm*—Chapman and Cutler LLP

(57) ABSTRACT

A cartridge comprises a container 11 for housing a connected staple, a driving section 21 for driving a staple, a conveying path 25 which extends from the container 11 to the driving section 21, and conveys the connected staple, a feeding member 30 which is disposed in a position remote from a guide member 23 forming the conveying path 25, and reciprocates along the conveying path, feeding claws 31A, 31B having leading end portions which are attached to the feeding member 30, and project in the conveying path 25 from openings 23A, 23B formed in the guide wall 23, and the connected staple being fed toward the driving section 21 by the feeding claws 31A, 31B when the feeding member 30 advances. The cartridge further comprises a link mechanism 50 for moving the feeding member 30 backward when a lid 13 of the container 11 is opened.

12 Claims, 7 Drawing Sheets

CARTRIDGE

TECHNICAL FIELD

The present invention relates to a cartridge for housing a roll staple in which a connected staple is wound in a roll shape.

BACKGROUND ART

Conventionally, there has been known a cartridge having a container for housing a roll staple in which a connected staple is wound in a roll shape, a driving section for driving the staple, and a conveying path extending from the container to the driving section and for conveying the connected staples.

The cartridge is provided with a sliding member in a position remote from a wall surface forming the conveying path. The sliding member is reciprocatably disposed along the conveying path. The sliding member is provided with a feeding claw. The leading end of the feeding claw is projected in the conveying path from an opening formed in the wall surface. The feeding claw feeds the connected staple toward the driving section when the sliding member moves forward.

When the jamming of the staple occurs in the driving section, the staple has to be taken out. However, if the connected staple is connected to the staple, the connected staple is pulled out. Accordingly, the pulled out connected staple has to be brought back in the opposite direction of the conveying direction. However, there was a problem that the pulled out connected staple cannot be brought back in the opposite direction of the conveying direction because the leading end portion of the feeding claw is projected in the conveying path from the opening of the wall surface.

It is, therefore, an object of the present invention to provide a cartridge which can bring back the pulled out connected staple in the opposite direction of the conveying direction.

DISCLOSURE OF INVENTION

In order to achieve the above described object, the present invention according to claim 1 is a cartridge comprising a container for housing a connected staple, a driving section for driving a staple, a conveying path which extends from the container to the driving section, and conveys the connected staple, a feeding member which is disposed in a position remote from a guide wall forming the conveying path, and reciprocates along the conveying path, a feeding claw having a leading end portion which is attached to the feeding member, and projects in the conveying path from an opening formed in the guide wall, and the connected staple being fed toward the driving section by the feeding claw when the feeding member advances. The cartridge is characterized in that the feeding claw is drawn into the opening of a wall surface of the guide wall when a lid of the container is opened.

The present invention according to claim 2 is a cartridge comprising a container for housing a connected staple, a driving section for driving a staple, a conveying path which extends from the container to the driving section, and conveys the connected staple, a feeding member which is disposed in a position remote from a guide wall forming the conveying path, and reciprocates along the conveying path, a feeding claw having a leading end portion which is attached to the feeding member, and projects in the conveying path from an opening formed in the guide wall, said connected staple being fed toward the driving section by the feeding claw when the feeding member advances. The cartridge is characterized in that the cartridge further comprises a movement device to move the feeding member in a direction opposite to the conveying direction of the connected staple when a lid of the container is opened, and the feeding claw is drawn into the opening of the guide wall when the feeding member is moved backward by the movement device.

BEST MODE FOR CARRYING OUT THE INVENTION

Hereinafter, embodiments of a cartridge according to the present invention will be explained based on the drawings.

(First Embodiment)

Figure 1:
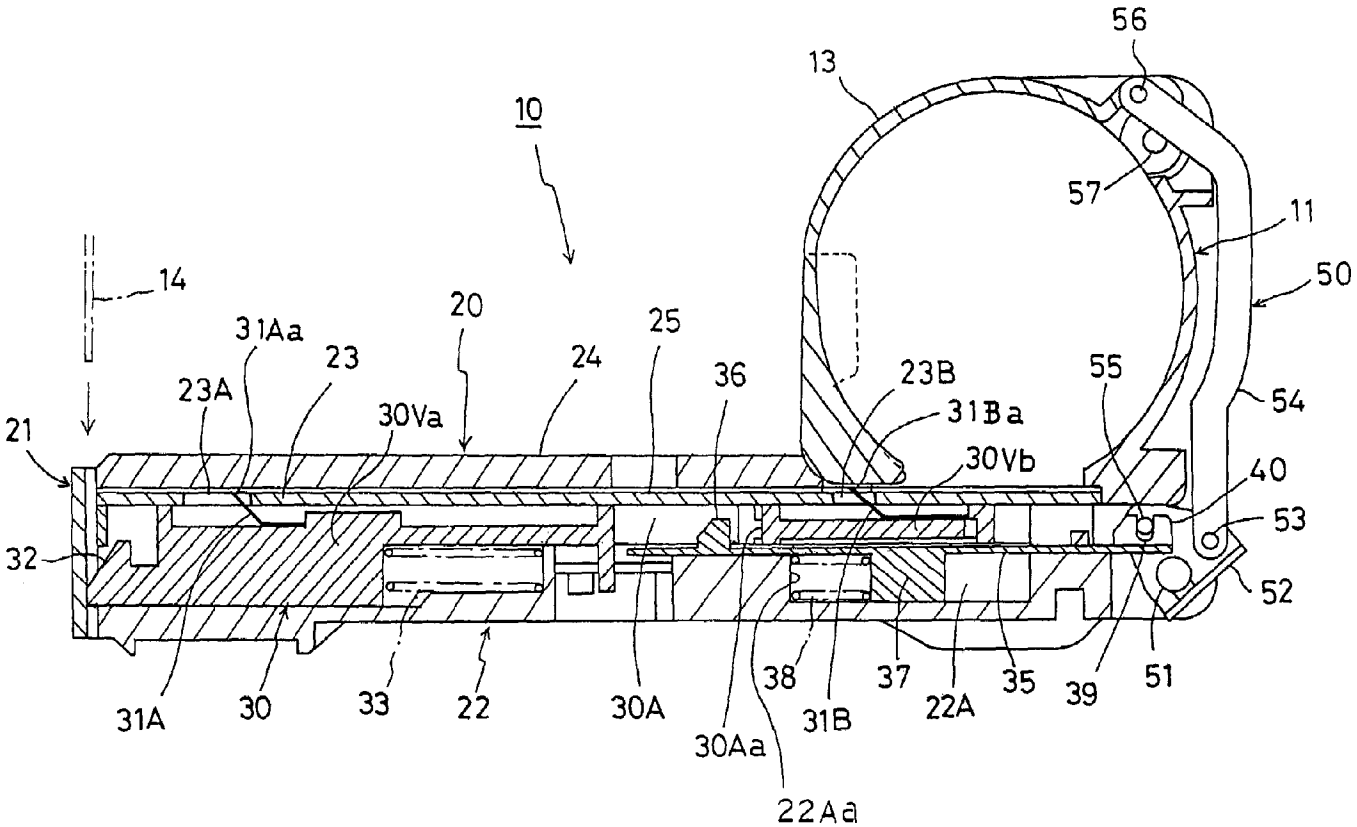
FIG. 1 is a cross section view illustrating a cartridge structure according to the present invention.

In FIG. 1, a reference numeral 10 is a cartridge attachably and detachably mounted on a motor operated stapler (not shown). The cartridge 10 comprises a container 11 for housing a roll staple (not shown) in which a connected staple (not shown) is wound in a roll shape, a lid 13 attached to the container 11 in an openable and closeable manner, and a conveying portion 20 incorporated into the container 11.

A leading end of the conveying portion 20 (front portion: far left portion in FIG. 1) is provided with a driving section 21 for driving a staple by the entrance of a driver 14 disposed in a motor operated stapler body (not shown).

The conveying portion 20 is provided with a base member 22 which extends backward and forward and is fixed to the container 11. The base member 22 is provided with a pair of guide walls 23, 24 extending in the back and front directions, between which a conveying path 25 is formed. One end of the conveying path 25 extends to the driving section 21, and the back portion of the conveying path 25 communicates with the inside of the container 11.

Openings 23A, 23B are respectively formed in the front side and the back side of the guide wall 23, and a feeding member 30, which can reciprocate backwardly and forwardly, is disposed between the guide wall 23 and the base member 22. A feeding claw 31A projected diagonally upward left (in FIG. 1) is attached to a front portion 30Va of the feeding member 30, and a feeding claw 31B is attached to the back portion 30Vb of the feeding member 30. Leading end portions 31Aa, 31Ba of the feeding claws 31A, 31B are projected in the conveying path 25 from the openings 23A, 23B of the guide wall 23.

The leading end portion of the feeding member 30 (left side in FIG. 1) is formed with a titled guide plane 32. When the driver enters the driving section 21, and the staple is driven by the driver, the driver 14 abuts with the guide plane 32.

The feeding member 30 is forwardly energized by a spring 33. When the driver enters into the driving section 21 so as to abut with the guide plane 32 of the feeding member 30, the guide plane is pushed by the driver, so that the feeding member 30 moves backward against a biasing force of the spring 33. When the sliding member 30 moves backward, the leading end portions 31Aa, 31Bb of the feeding claws 31A, 31B abuts with the rims of the openings 23A, 23B of the guide wall 23, and then the leading end portions 31Aa, 31Bb of the feeding claws 31A and 31B are drawn into the openings 23A, 23B from the conveying path 25.

When the driver returns to a waiting position (chained line position), the feeding portion 30 moves forward by the biasing force of the spring 33. When the feeding portion 30 moves forward, the leading end portions 31Aa, 31B of the feeding claws 31A, 31B are projected in the conveying path 25 from the openings 23A, 23B, and the connected staple is fed forward.

A sliding plate 35 is disposed between the back portion 30Vb side of the feeding member 30 and the base member 22 in backwardly and forwardly reciprocatable manner. A sliding plate 35 is provided with a projection 36 which is projected upward (FIG. 1) and is entered in a hole section 30A as an intermediate portion of the feeding member 30 and a projection 37 which is projected downward and is entered in a concave portion 22A of the base member 22. A clearance of predetermined distance is set between the projection 36 and an end face 30Aa of the right side of a concave portion 30A of the feeding member 30. A spring 38 is disposed between an end face 22Aa of the left side of the concave portion 22A of the base member 22 and the projection 37 of the sliding plate 35, and the sliding plate 35 is energized backward (in the right direction in FIG. 1) by the spring 38.

The spring 38 biases a lid 13 in the opening direction, and the lid 13 is maintained in the opened state by this biasing, so that the supplement becomes easy when a new roll staple is supplied. Moreover, the spring 38 prevents the jouncing of the lid 13 when the lid 13 is closed.

A bearing section 40 having a concave shaped bearing 39 is formed in the back portion of the sliding plate 35.

Figure 2:
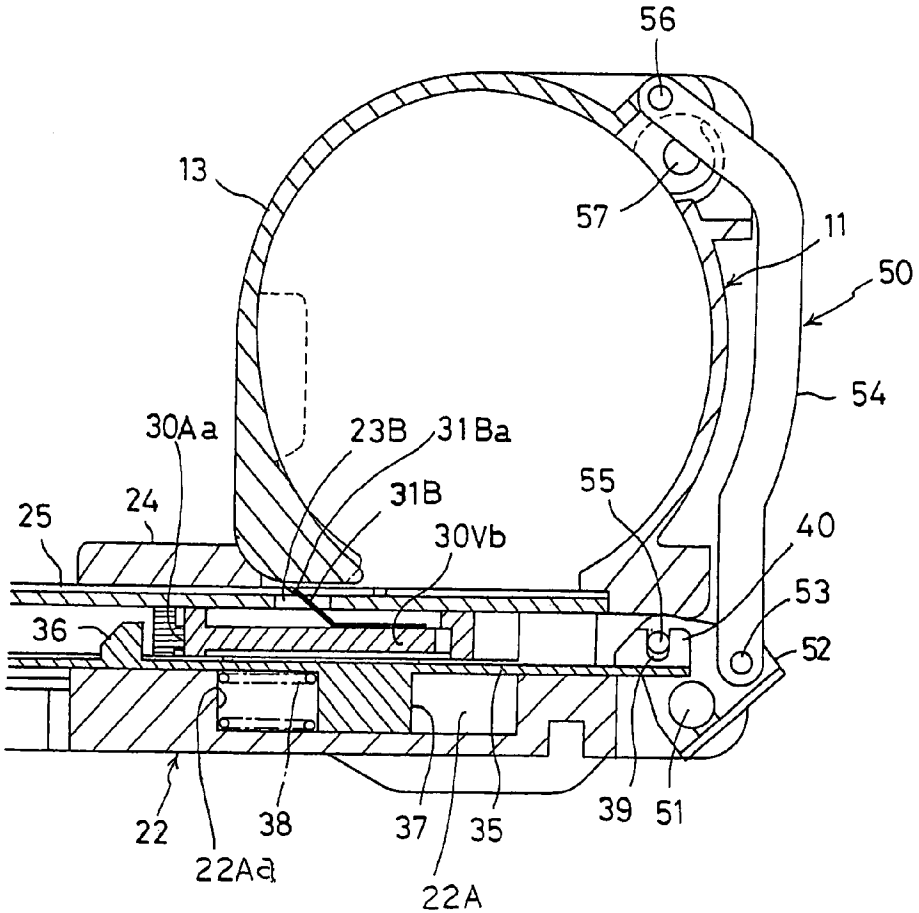
FIG. 2 is a cross section view of a partly enlarged cartridge shown in FIG. 1.

A link mechanism (movement device) 50 as shown in FIG. 2 is provided in the back portion of the base member 22. The movement device for moving the feeding member 30 backward is constructed by the link mechanism 50 and the sliding plate 35.

The link mechanism 50 includes a link member 52 which is rotatably attached to a shaft 51 provided in the back end of the base member 22, and a connecting member which is rotatably pivoted by a shaft 53 provided in the link member 52.

The link member 52 is provided with a shaft 55, and the shaft 55 is rotatably engaged in the bearing 39 of the bearing section 40 of the sliding plate 35. The shaft 55 is positioned upward (FIGS. 1, 2) and the left side of the shaft 51 of the base member 22. The shaft 53 is positioned upward and the light side of the shaft 51, and also is positioned downward of the shaft 55.

The connecting member 54 extends up and down (FIGS. 1, 2), and the upper portion of the connecting member 54 is pivotably supported by a shaft 56 provided in the rear portion of the lid 13. The shaft 56 is positioned in the upper side and the left side of the shaft 57 by which the lid 13 is rotatably pivoted to the container 11. The lid 13 opens by rotating in the clockwise direction about the shaft 57 as a center.

Figure 3:
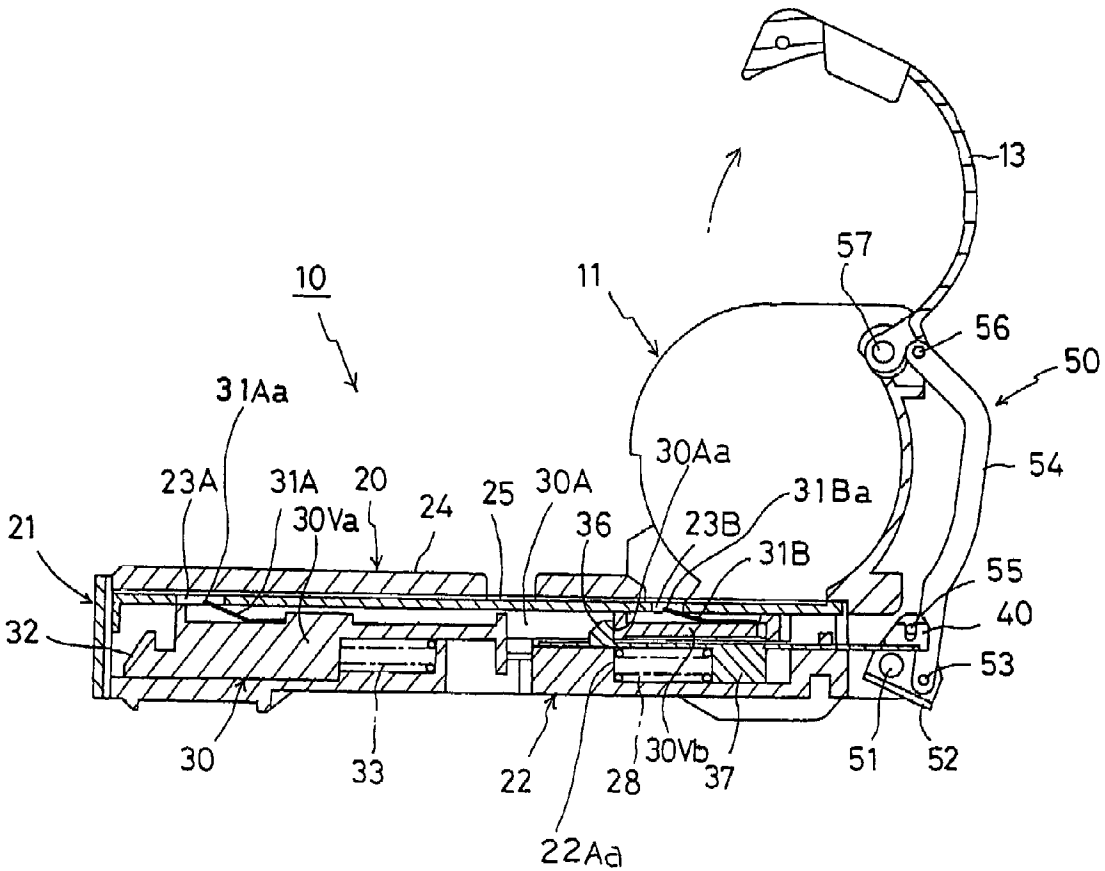
FIG. 3 is a cross section view of cartridge illustrating a lid opening state.
Figure 4:
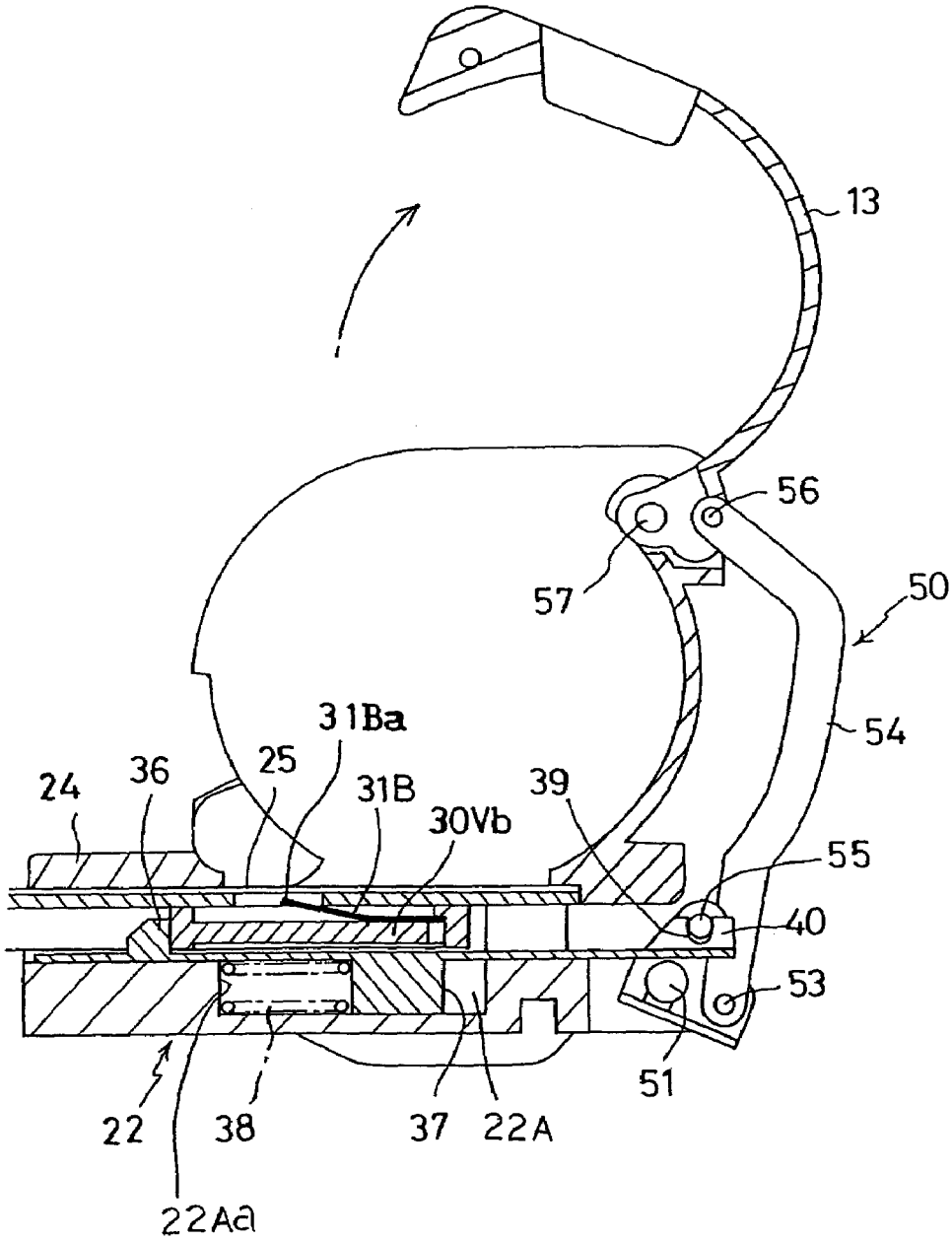
FIG. 4 is a cross section view of a partly enlarged cartridge shown in FIG. 3.

When the lid 13 opens as shown in FIGS. 3, 4, the lid 13 rotates in the clockwise direction about the shaft 57 as a center. The connecting member 54 moves downward by this rotation. When the connecting member 54 moves downward, the link member 52 rotates in the clockwise direction about the shaft 51 of the base member 22 as a center. When the link member 52 rotates in the clockwise direction, the shaft 55 of the link member 52 is moved backward, so that the sliding plate 35 moves backward.

When the sliding plate 35 moves backward in a predetermined distance, the projection 36 of the sliding plate 35 abuts with the end face 30Aa of the concave portion 30A of the feeding member 30. As the movement of the sliding member in the backward direction, the feeding member 30 moves backward together with the sliding plate 35.

By the movement of the feeding member 30 in the backward direction, the feeding claws 31A, 31B of the feeding member 30 abut with the right side rims of the openings 23A, 23B of the guide wall 23, and the feeding claws 31A, 31B are inclined forward, and then the leading end portions of the feeding claws 31A, 31B are drawn into the openings 23A, 23B of the guide wall 23.

As described above, when the lid 13 opens, the leading end portions of the feeding claws 31A, 31B are drawn into the openings 23A, 23B of the guide wall 23, so that the engagement between the connected staple and the feeding claws 31A, 31B can be released, and the pulled out connected staple can be brought back to the opposite direction of the conveying direction when jamming occurs.

In this embodiment, the feeding member 30 is moved backward through the sliding plate 35, but the feeding member 30 may be directly moved backward by the link mechanism 50.

Figure 5:
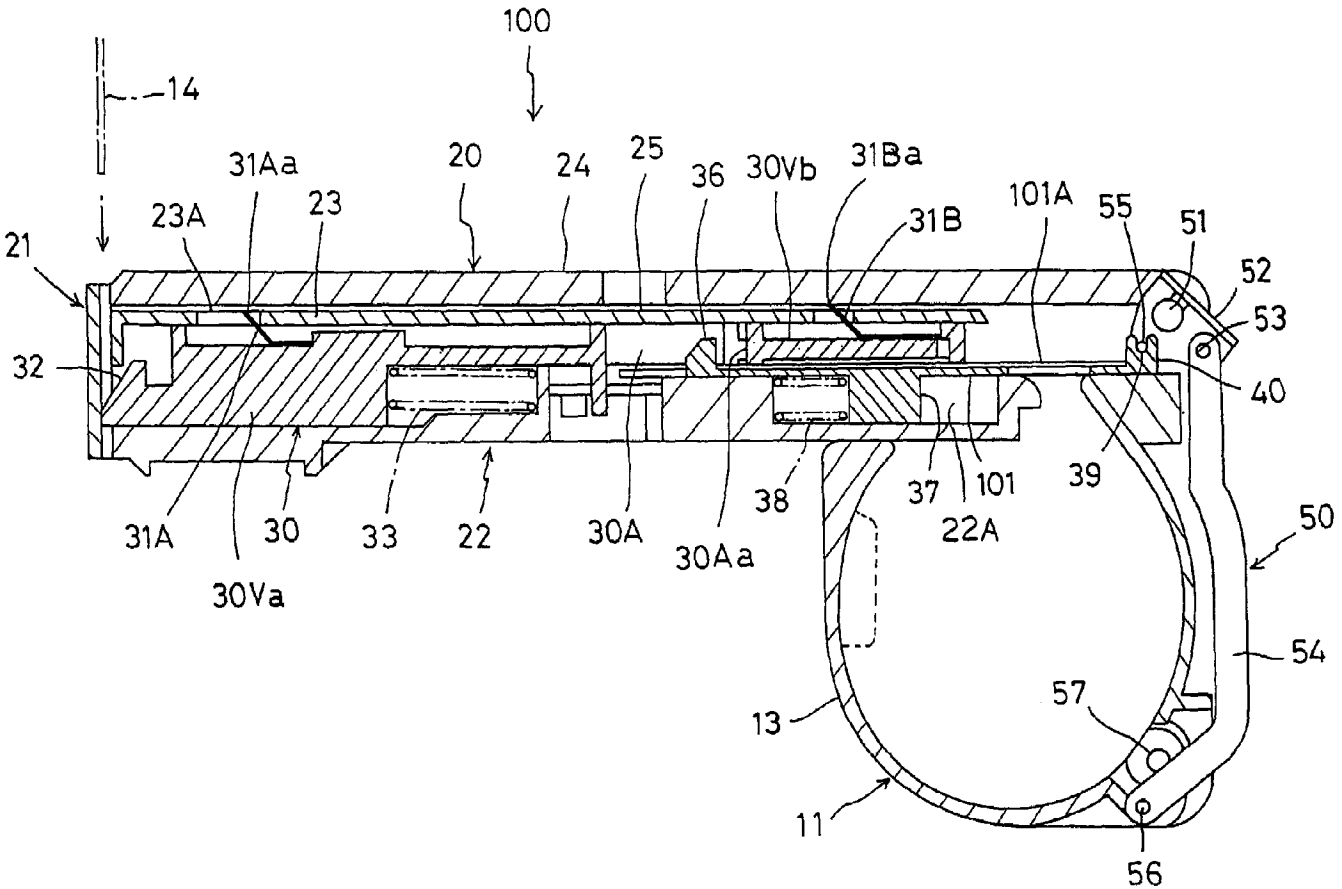
FIG. 5 is an explanation view illustrating another example of a cartridge.

In a cartridge 100 shown in FIG. 5, a container 11 is disposed in the lower side of a conveying path 25 (FIG. 5).

The cartridge 100 is provided with a hole 101A in the rear portion side of a sliding plate 101. The cartridge 100 is adopted to feed a connected staple (not shown) in the container 11 through the hole 101A.

Figure 6:
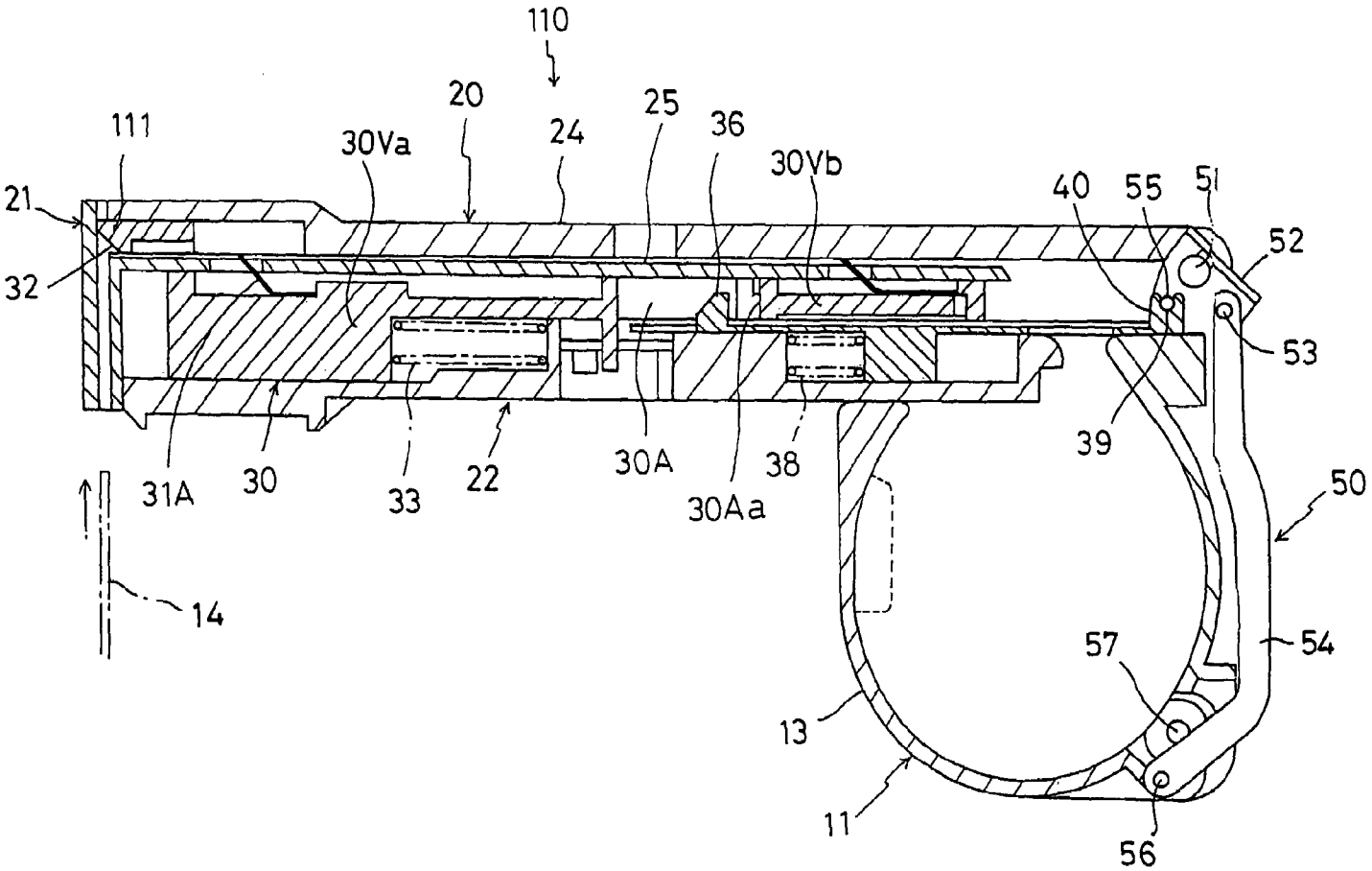
FIG. 6 is an explanation view showing another example of a cartridge.

In a cartridge 110 shown in FIG. 6, a container 11 is provided in the lower side of the conveying path 25 (FIG. 5), and the driver 14 is driven from the lower side toward the upper side.

In the cartridge 110, a guide section 111 provided on a conveying path 25 is disposed in the leading end of a feeding member 30, and a inclined guide plane 32 is disposed in the guide portion 111.

(Second Embodiment)

Figure 7:
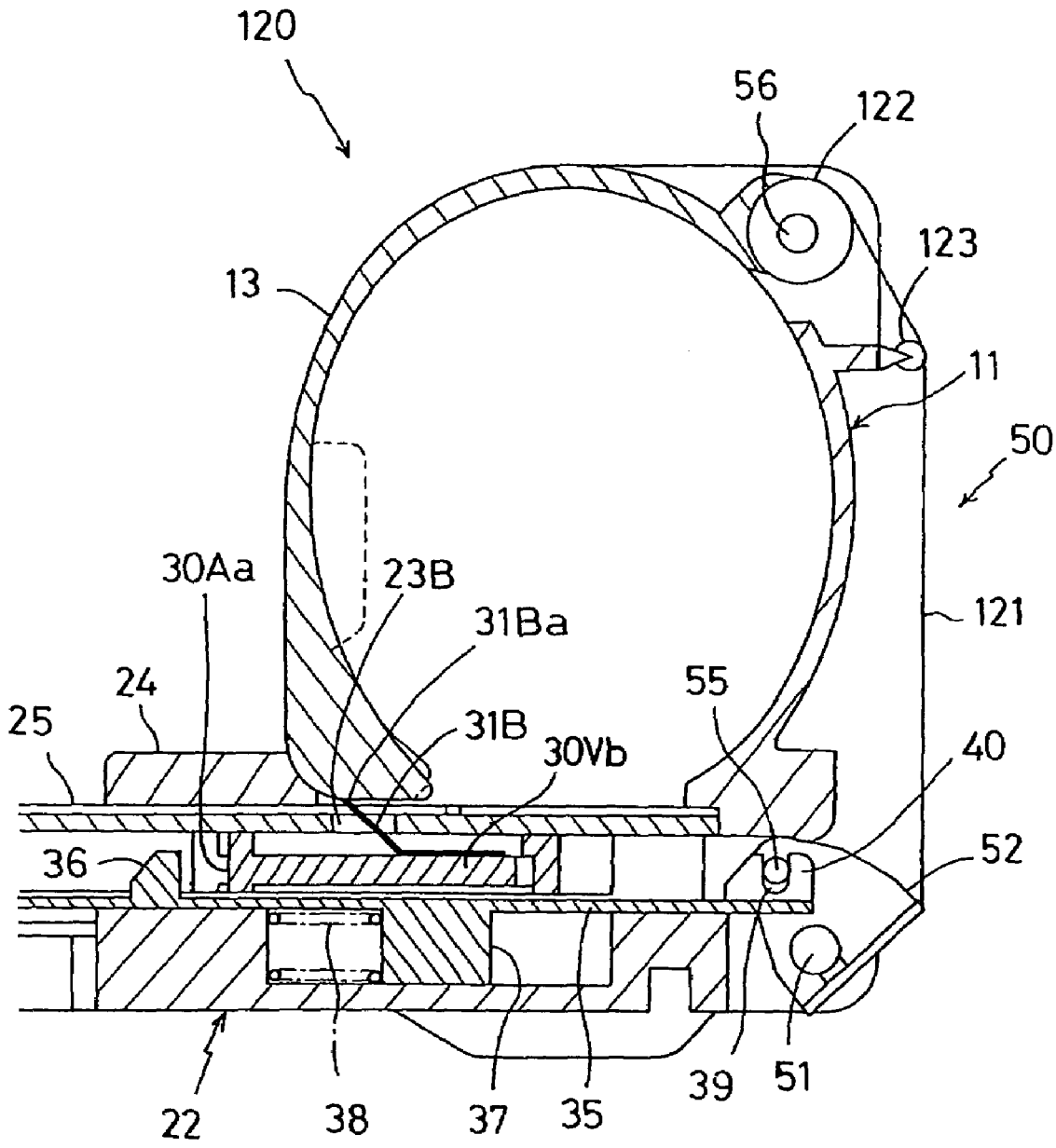
FIG. 7 is an explanation view illustrating a cartridge of a second embodiment.

FIG. 7 is a cartridge 120 illustrating the second embodiment. The cartridge 120 is adopted to move a sliding plate 35 by using a wire 121 instead of using the connecting member 54.

In FIG. 7, a reference numeral 122 denotes a take-up roller provided in a shaft 56 by which a lid 13 is supported. The take-up roller 122 is fixed to the lid 13 and rotates about the shaft 56 with the opening and closing of the lid 13. One end of the wire 121 is fixed to the take-up roller 122, and the other end of the wire 121 is fixed to one end of a link member 52. A reference numeral 123 is a roller attached to the container 11.

When the lid 13 opens, the take-up roller 122 rotates in the clockwise direction. The wire 121 is unstrained by this rotation, so that the sliding plate 35 moves backward by the biasing force of a spring 38.

When the lid 13 is closed, the take-up roller 122 rotates in the counter-clockwise direction, and the wire 121 is wound, so that the link member 52 rotates in the counter-clockwise direction about a shaft 51 as a center with the closing of the lid 13, and the sliding plate 35 moves forward against the spring 38 by the rotation in the counter-clockwise direction of the link member 52.

As described above, according to the present invention, a connected staple which is pulled out at the time of jamming can be brought back in the opposite direction of the conveying direction.

What is claimed is:

1. A cartridge comprising:

a container for housing a connected staple;

a driving section for driving a staple;

a conveying path which extends from said container to said driving section, and conveys said connected staple;

a feeding member which is disposed in a position remote from a guide wall forming the conveying path, and reciprocates along the conveying path; and a feeding claw comprising a leading end portion which is attached to said feeding member, and projects into the conveying path from an opening formed in said guide wall;

said connected staple being fed toward the driving section by said feeding claw when said feeding member advances, wherein said feeding claw is drawn into the opening of a wall surface of said guide wall when a lid of said container is opened.

2. The cartridge according to claim 1, wherein said connected staple is a roll staple in which the staples are connected and wound.

3. A cartridge comprising;

a container for housing a connected staple;

a driving section for driving a staple;

a conveying path which extends from said container to said driving section, and conveys the connected staple;

a feeding member which is disposed in a position remote from a guide wall forming said conveying path, and reciprocates along the conveying path; and a feeding claw comprising a leading end portion which is attached to said feeding claw, and projects into the conveying path from an opening formed in said guide wall;

said connected staple being fed toward the driving section by said feeding claw when said feeding member advances, wherein said cartridge further comprises a movement device to move said feeding member in a direction opposite to a conveying direction of the connected staple when a lid of said container is opened, and said feeding claw is drawn into the opening of said guide wall when said feeding member is moved backward by said movement device.

4. The cartridge according to claim 3, wherein said movement device is a link mechanism.

5. The cartridge according to claim 4, wherein said link mechanism comprises a link member which is pivotably supported on a base member provided on said conveying path, and a connected member in which one end is supported by said lid and a second end is supported by said link member, said connected member rotates said link member by opening said lid, and said feeding member or said sliding plate is moved in an opposite direction by rotation of said link member.

6. The cartridge according to claim 5, wherein said connected staple is a roll staple in which the staples are connected and wound.

7. The cartridge according to claim 4, wherein said connected staple is a roll staple in which the staples are connected and wound.

8. The cartridge according to claim 3, wherein said connected staple is a roll staple in which the staples are connected and wound.

9. A cartridge comprising:

a container for housing a connected staple;

a driving section for driving a staple;

a conveying path which extends from said container to said driving section, and conveys said connected staple;

a feeding member which is disposed in a position remote from a guide wall forming the conveying path, and reciprocates along the conveying path; and a feeding claw comprising a leading end portion which is attached to said feeding member, and projects into the conveying path from an opening formed in said guide wall;

said connected staple being fed toward the driving section by said feeding claw when said feeding member advances, wherein said cartridge further comprises a movement mechanism for moving said feeding member in a direction opposite to a conveying direction of the connected staple, said movement mechanism comprises a sliding plate which moves said feeding member in the opposite direction by moving in said opposite direction and a link mechanism which moves the sliding plate in the opposite direction by opening said lid, and said feeding claw is drawn into the opening of said guide wall when said feeding member is moved backward.

10. The cartridge according to claim 9, wherein said link mechanism comprises a link member which is pivotably supported on a base member provided on said conveying path, and a connected member in which one end is supported by said lid and a second end is supported by said link member, said connected member rotates said link member by opening said lid, and said feeding member or said sliding plate is moved in an opposite direction by rotation of said link member.

11. The cartridge according to claim 10, wherein said connected staple is a roll staple in which the staples are connected and wound.

12. The cartridge according to claim 9, wherein said connected staple is a roll staple in which the staples are connected and wound.

* * * * *